United States Patent [19]

Archer

[11] Patent Number: 4,887,625

[45] Date of Patent: Dec. 19, 1989

[54] COLLAPSIBLE CANE

[75] Inventor: Arvo T. Archer, County of St. Louis, Mo.

[73] Assignee: Americane, Inc., Maryland Heights, Mo.

[21] Appl. No.: 200,055

[22] Filed: May 26, 1988

[51] Int. Cl.[4] ..... A45B 9/00

[52] U.S. Cl. ..... 135/75; 403/109; 403/104; 135/77

[58] Field of Search ..... 135/75, 69, 108, 77; 403/109, 104

[56] References Cited

U.S. PATENT DOCUMENTS

| | | | |
|---|---|---|---|
| 2,456,205 | 12/1948 | Magder | 403/104 |
| 2,587,511 | 2/1952 | Nerman | 403/104 |
| 2,599,222 | 6/1952 | Bergquist | 403/104 |
| 3,153,252 | 10/1964 | Ricciardi | 135/75 |
| 3,456,662 | 7/1969 | Weber | 135/75 |
| 3,515,418 | 6/1970 | Nielsen | 403/109 |
| 3,987,807 | 10/1976 | Varnell | 135/75 |
| 4,073,456 | 2/1978 | Karapita | 403/104 |
| 4,238,164 | 12/1980 | Mazzolla | 403/109 |
| 4,448,442 | 5/1984 | Weber-Henning | 135/75 |
| 4,508,467 | 4/1985 | Coffin | 403/104 |

*Primary Examiner*—Henry E. Raduazo

*Attorney, Agent, or Firm*—Polster, Polster and Lucchesi

[57] ABSTRACT

A collapsible cae or the like is disclosed as having a series of interfitting telescoping sections which are interlocked together when collapsed and interlocked against collapse when extended. The collapsible cane includes first interlocking elements for externally interlocking the interfitting telescoping sections together as a unit when collapsed, and also capable of being released, by hand pressure, to permit elongated extension of the interfitting telescoping sections. When extended, second interlocking elements are provided for internally interlocking adjacent telescoping sections together against collapse. The second interlocking elements may also be deactivated to permit collapse and telescoping of adjacent interfitting telescoping sections relative to one another for compact storage, when collapsed, and for subsequent re-engagement with the first interlocking elements to hold the telescoped interfitting sections together as a unit.

21 Claims, 2 Drawing Sheets

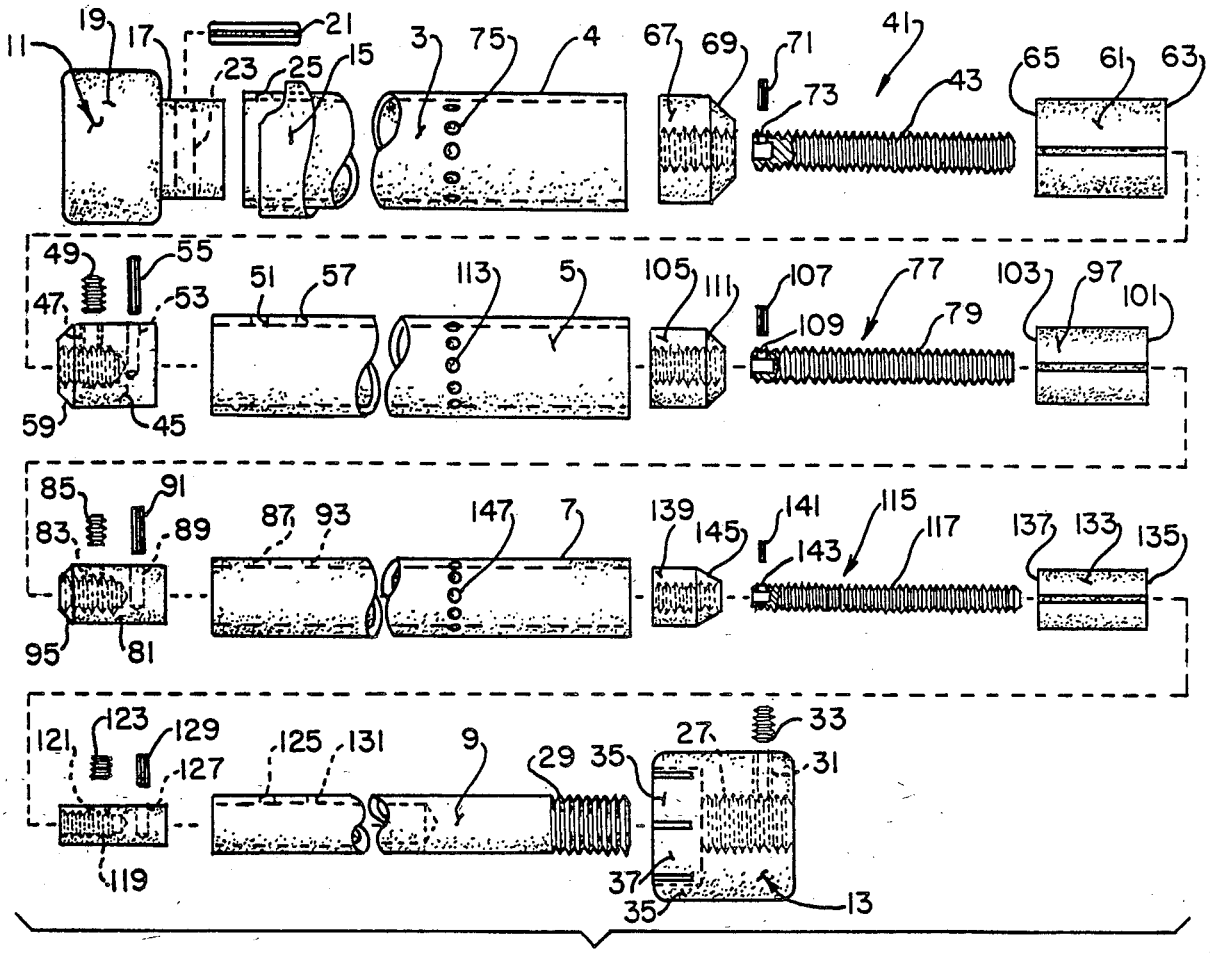
FIG. 5.
FIG. 6.
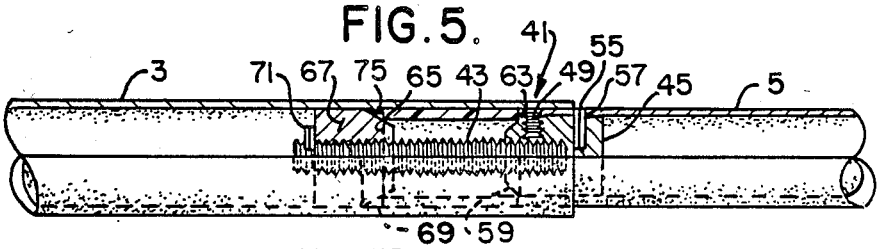
FIG. 7.
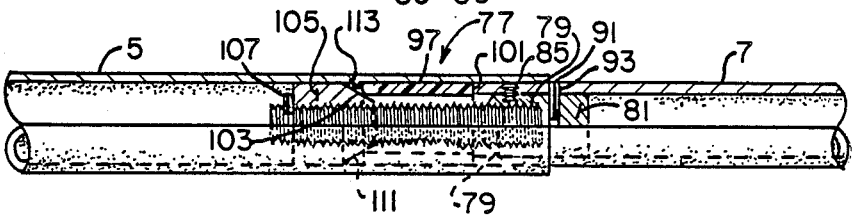
FIG. 8.
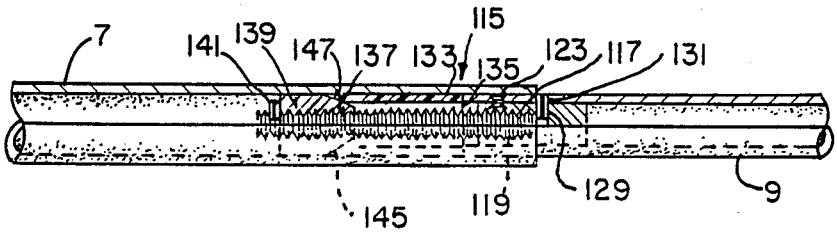

COLLAPSIBLE CANE

BACKGROUND OF THE INVENTION

The present invention relates to collapsible canes for use by handicapped people, and more particularly, to a collapsible cane having interfitting telescoping sections which are interlocked together when collapsed and interlocked against collapse when extended.

Walking canes had been used throughout the ages to assist handicapped people in walking, and have been made in a variety of different shapes and forms. Most walking canes are manufactured in one-piece, usually of wood or metal. Most recently, strong and lightweight metals, such as anodized aluminum, have been used to improve the weight of canes, while also providing a strong supporting structure and long life.

Most handicapped people have common needs in the selection and use of walking canes. Some handicapped people, i.e., blind persons, become heavily dependent on the use of walking canes because they are used daily to identify and locate objects within the walking pathway of blind persons.

Where walking canes are used frequently, they must be reliable, durable and long lasting in use. At the same time, canes can become a bothersome nuisance when the user assumes a sitting position. Canes then become cumbersome because it is difficult to find a convenient out-of-the-way resting place. Furthermore, some handicapped people prefer that canes become "hidden from view" so that others will not readily be reminded of the handicap of the cane user.

Some of the aforementioned problems can be alleviated where canes are collapsible. In such a case, the handicapped person can easily collapse the cane, following use. As will be expected, there have been a variety of collapsible, folding and telescoping canes that have sought to provide the seemingly contradictory needs of a strong and durable cane during walking, while providing a collapsible cane that can be quickly collapsed, during sitting. Applicant is aware of the following constructions which have sought to fulfill this need of cane users: U.S. Pat. No. 3,987,807 which discloses a telescopic walking cane with a helical coil spring within the telescoped interfitting sections to facilitate collapse of the cane when not in use; U.S. Pat. No. 4,106,521 which suggests the use of telescoping legs with a rotatable collar locking mechanism similar to that used in camera tripods and the like; U.S. Pat. No. 4,527,579 which shows a lockable hinge mechanism for a folding walking cane; U.S. Pat. Nos. 4,085,763 and 4,528,998 which both teach the use of the well known spring button latch for locking receipt within apertures of telescoping sections; and U.S. Pat. No. 4,582,079 which also shows a telescoping rod mechanism including a pivoting latch within inter-fitting telescoping sections for engagement with apertures in adjacent interfitting telescoping sections. While the above described constructions employ features which have been used, in part, for collapsible walking canes, they have not been used on a wide commercial basis because they do not, in fact, achieve the desired purpose of providing a strong and durable cane during walking use, and a quickly and conveniently collapsed and compactly stored cane, when not in use.

SUMMARY OF THE INVENTION

Among the several objects and advantages of the present invention include:

the provision of a new and improved collapsible cane for handicapped persons;

the provision of the aforementioned collapsible cane which is strong and durable for walking support, and yet is collapsible for convenience storage when not in use.

the provision of the aforementioned collapsible cane for use by handicapped persons enabling the cane to be quickly and easily collapsed from an extended position to a compact position for carrying or storage purposes, and subsequent return back to an extended position, as desired;

the provision of such aforementioned collapsible cane which has a series of interfitting telescoping sections which are held together as unit when collapsed, and interlocked together when in extended position;

the provision of the aforementioned collapsible cane which includes axially interlocking for holding interfitting telescoping sections together as a unit when collapsed, and rotary interlocking for adjacent telescoping sections when extended;

the provision of the aforementioned collapsible cane which is easy to use; is reliable and efficient in operation; is of rugged and durable construction; can be quickly and easily converted between use and storage; protects the user from electrical shock; provides a reflective surface to facilitate location; and is otherwise well adapted for the purposes intended.

Briefly stated, the collapsible cane of the present invention is provided with a series of interfitting telescoping sections which are interlocked together when collapsed and interlocked against collapse when extended. The collapsible cane includes first interlocking means for externally interlocking the interfitting telescoping sections together as a unit, when collapsed. The first interlocking means is also capable of being released to permit longitudinal extension of the interfitting telescoping sections. The collapsible cane is further provided with second interlocking means for internally interlocking adjacent telescoping sections together against collapse, when activated. When the second interlocking means is deactivated, the telescopic interfitting sections may be telescoped with respect to one another for subsequent re-engagement with the first interlocking means. In some cane designs, the interfitting telescoping sections may be solely provided with internal expansion means for engagement with an inner wall of adjacent telescoping sections, when activated, to interlock adjacent telescoping sections together against collapse, and when de-activated, permitting collapse and telescopic interfitting assembly of adjacent interfitting telescoping sections relative to one another. Preferably, axial interlocking means are used for holding the interfitting telescoping sections together as a unit, when collapsed, with rotary interlocking means being used for interlocking adjacent telescoping sections against collapse, when extended.

Other objects and advantages will become apparent from the description that follows:

BRIEF DESCRIPTION OF THE DRAWINGS

In the drawings.

FIG. 5 is an exploded fragmentary front elevational view, partially insecton, and also being essentially of full size, illustrating the various components incorporated within the collapsible cane of the present invention;

FIG. 6 is a fragmentary side elevational view, partially in section, also being a full size representation, of the internal expansion assembly which interlocks adjacent interfitting telescoping sections relative to one another;

FIG. 7 is also a fragmentary side elevational view, partially in section, illustrating a full size representation of different adjacent interfitting telescoping sections which are interlocked to one another by another internal expansion assembly; and FIG. 8 is a further side elevational view, partially in section, illustrating in full size representation yet another internal expansion assembly for interlocking smaller telescoping interfitting sections of the collapsible cane of the present invention.

Corresponding reference numerals will be used throughout the various figures of the drawings.

DESCRIPTION OF PREFERRED EMBODIMENTS

Figures 1, 2, 3, 4:
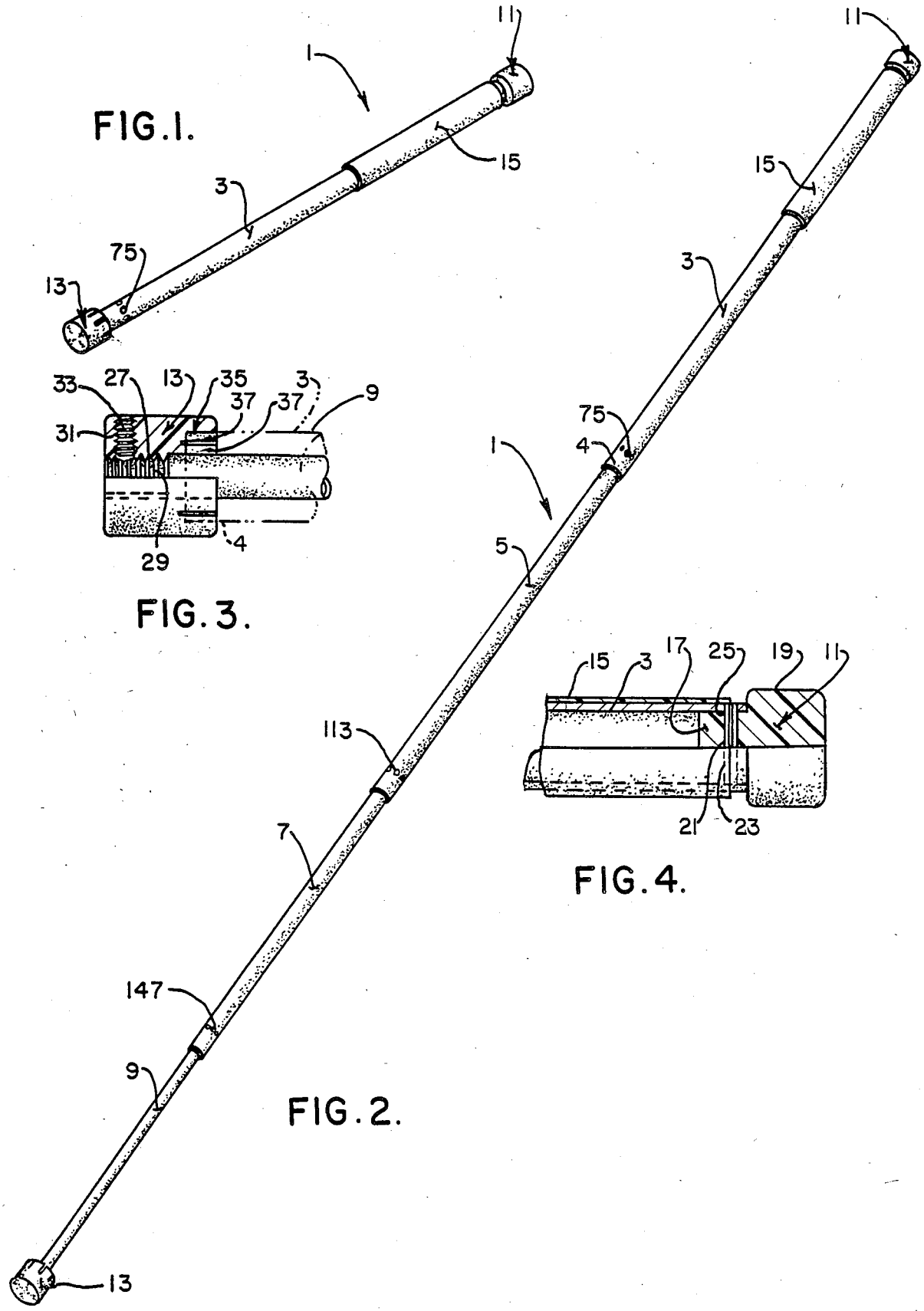
FIG. 1 is a perspective view of the collapsible cane constructed in accordance with the teachings of the present invention, with the cane shown in collapsed position for compact storage thereof.
FIG. 2 is a perspective view of the collapsible cane of the present invention, with the interfitting telescoping sections being extended for use in walking.
FIG. 3 is an enlarged fragmentary side elevational view, partially in section, of an essentially a full sized illustration of the cane tip area of the collapsible cane of the present invention.
FIG. 4 is also an enlarged fragmentary side elevational view, partially in section, essentially being a full size representation of the top or upper end of the collapsible cane.

The collapsible cane 1 shown in FIG. 1–2 of the drawings has a series of interfitting telescoping sections which are interlocked together when collapsed, and interlocked against collapse when extended. Specifically, the collapsible cane 1 includes in descending order of size, the largest outermost telescoping section 3, intermediate interfitting telescoping sections 5 and 7, and the smallest interfitting telescoping section 9, as best seen in FIG. 2 of the drawings. At the outer free end of the largest interfitting telescoping section 3 is a closure or top 11, and at the smallest interfitting telescoping section 9, there is a cane tip 13 attached to the outer free end thereof. Preferably each of the interfitting telescoping sections 3, 5, 7 and 9 are formed as cylindrical tubes from anodized aluminum which provides a lightweight, durable, and noncorrosive construction. To prevent electrical shock to the user of the collapsible cane 1, an elongated circumferentially extending band 15 of insulating material surrounds the largest interfitting telescoping section 3 adjacent the closure or top 11. Suitable light reflecting means may also be applied to the exterior of the largest interfitting telescoping section 3 to facilitate locating same in dark surroundings.

The manner in which the closure or top 11 and the cane tip 13 is secured to the collapsible cane 1 is best seen in FIGS. 3–4 of the drawings. Referring first to FIG. 4 of the drawings, it will be seen that the closure or top 11 includes inner and outer circumferential portion 17, 19 respectively, the inner circumferential portion 17 being received within the open outer end of the largest interfitting telescoping section 3, while the outer circumferential portion 19 serves as a knob or handgrip for the collapsible cane 1. The closure or top 11 is secured to the outermost interfitting telescoping section 3 by a roll pin 21 which is received within aligned openings 23 of the closure or top 11 and opening 25 of the outermost interfitting telescoping section 3. Thus, the closure or top 11 is securely mounted to the collapsible cane 1 via the largest interfitting telescoping section 3, and also, because of being made from a plastic material such as "Nylon", serves with the insulating section 15 to protect the user of the collapsible cane 1 from electrical shock in the event any of the anodized aluminum tubular interfitting telescoping sections 3 through 9 come in contact with an electrical outlet, wires or the like.

The manner in which the cane tip 13 is mounted to the collapsible cane 1 is best seen in FIGS. 3 and 5 of the drawings. The cane tip 13 is also preferably made from a plastic material such as "Nylon" and has an internally threaded bore 27 for cooperative threaded mating engagement with the threads 29 at the free end of the smallest interfitting telescoping section 9. The body of the cane tip 13 further has a transversely extending threaded opening 31 for receiving a set screw 33 for engaging the threads 29 of the smallest interfitting telescoping section 9, in order to securely retain the cane tip 13 to the outermost end of the smallest telescoping section 9, as will be appreciated.

In order to releasably engage the inner end 4 of the largest interfitting telescoping section 3 with the cane tip 13, the cane tip 13 is provided with a resiliently expandable collar portion 35 for releasable engagement and disengagement relative to the inner end 4 of the outermost and largest interfitting telescoping section 3. The resiliently expandable collar portion 35 of the cane tip 13 includes a series of circumferentially extending and resiliently expandable fingers 37 for resilient external gripping engagement with the inner end 4 of the largest interfitting telescoping section 3 of the collapsible cane 1. Thus, when all of the telescoping interfitting section 3, 5, 7 and 9 are collapsed as shown in FIG. 1 of the drawings, the inner end 4 of the largest interfitting telescoping section 3, as seen in FIG. 3 of the drawings, is designed to be releasably gripped and engaged through the resilient deflectable fingers 37 of the resiliently expandable collar portion 35 for externally interlocking the interfitting telescoping sections together as a unit. Once collapsed by hand pressure, with a longitudinally applied force in the direction of closing the telescoping sections, the inner end 4 will be brought into releasable engagement/disengagement relative to the resiliently expandable collar portion 35 of the cane tip. It can thus be seen that the resiliently expandable collar portion 35 serves as an axial interlocking and external gripping force relative to the inner end 4 of the largest interfitting telescoping section 3 of the collapsible cane 1.

Along with the aforementioned axial or external gripping of the collapsible cane 1, when in collapsed position, there is a second and independent interlocking means for interlocking the interfitting telescoping sections 3, 5, 7 and 9 against collapse, when fully extended, as shown in FIG. 2 of the drawings. As subsequently described, this second and independent interlocking means is constructed to internally expand against an inner wall of an adjacent interfitting telescoping section, to prevent collapse of the interfitting telescoping sections 3, 5, 7 and 9, when extended.

Reference now made to FIG. 5 which shows an exploded view of the components of the second interlocking means, as well as FIGS. 5–8 which illustrate how the second interlocking means interlocks the interfitting telescoping sections 3, 5, 7 and 9 relative to one another, to prevent collapse thereof.

As seen in FIG. 6 of the drawings, the second interlocking means 41 for the interfitting telescoping sections 3 and 5, as shown in the FIG. 5 exploded view, include the following components: An elongated threaded male stud 43 is threaded at one end into the generally cylindrical body 45, the later being press fit within the interfitting telescoping section 5. A transversely extending threaded opening 47 receives the said screw 49 for interengagement with the threaded male stud 43 securely holding the threaded male stud 43 relative to the generally cylindrically shaped body 45. A complementary transverse opening 51 in the side wall of the interfitting telescoping section 5 enables the set screw 49 to be threadably driven into locking engagement with the threaded male stud 43. Also within the generally elongated cylindrical body 45 is a transversely extending bore 53 for receiving a roll pin 55 therein. The roll pin 55 is designed to also be received within the transverse opening 57 in the side wall of the interfitting telescoping section 5, so as to axially and rotatably secure the cylindrical body 45 relative to the interfitting telescoping section 5.

The cylindrical body or element 45 further has a tapered or wedging surface 59, for purposes shortly to be described. Adjacent the body or wedge element 45 on the threaded male stud 43 is a longitudinally split locking cylinder 61 made from a flexible, yet durable material such as "Nylon". The tapered or wedge surface 59 of the body or element 45 is arranged to engage the locking cylinder 61 along an internal end surface 63 thereof, while the other internal end 65 of the locking cylinder 61 is engageable by the internally threaded body or wedge element 67 having a wedge or tapered surface 69 which engages the internal end 65 of the locking cylinder 61. When the wedge element 67 is threadable mounted on the threaded male stud 43, a roll pin 71 is inserted within a suitable opening 73 of the threaded male stud 43 to prevent unauthorized retrograde movement of the wedge element 67 from the threaded male stud 43.

In order to allow the second interlocking means to internally expand against the inner wall of the interfitting telescoping section 3, a series of circumferential depressions 75 are formed in the interfitting telescoping section 3 or any such similar circumferential surface, for engaging the wedge element 67 along the outer circumferential margin or periphery thereof adjacent the wedge or tapering surfaces 69, so as to prevent the wedge element 67 from moving beyond the circumferential depressions 75 in the interfitting telescoping section 3. When the telescoping interfitting sections 3 and 5 are extended relative to one another, the wedge element 67 is thus restricted from moving beyond the circumferential depressions 75. This allows rotation of the telescoping interfitting section 5 relative to the telescoping interfitting section 3, causing the wedge elements 45 and 67 to axially contact the locking cylinder 61 adjacent the inner ends 63, 65, thereby causing radial expansion of the locking cylinder 61 against the inner wall of the telescoping interfitting section 3. Less than a few turns of rotation of the telescoping interfitting section 5 relative to the telescoping interfitting section 3 is all that is required to cause internal expansion of the locking cylinder 61 against the inner wall of the telescoping interfitting section 3, to provide the internal frictional gripping and contact of the locking cylinders 61 along the entire length thereof relative to the inner wall of the interfitting telescoping section 3. This prevents axial collapse of the telescoping interfitting sections 3 and 5 relative to one another, even under sufficient axial force as would come by supporting the body of a handicap person, during walking.

Similarly, the second interlocking or internal expansion means 77, for the interfitting telescoping sections 5 and 7, includes threaded male stud 79 which is threadably engaged within the wedge element 81 and secured therein by the set screw 85 received within the transverse opening 83 of the wedge element 81. A corresponding opening 87 is provided in the interfitting telescoping section 7 for rotating the set screw 85 into locking engagement relative to the threaded male stud 79, while received within wedge element 81. A roll pin 91 is also received within a second transverse opening 89 in the wedge element 81, as well as within the corresponding and aligned opening 93 in the telescoping interfitting section 7, in order to securely mount and lock the wedge element 81 relative to the interfitting telescoping section 7, when mounted therein. The wedge element 81 has a tapered or wedge surface 95 for engaging the longitudinally slit locking cylinder 97 along the inner end 101, while the other end 103 of the locking cylinder 97 is engaged by the internally threaded wedge element 105, which is threadably mounted on the threaded male stud 79. The wedge element 105 secured in place on the threaded male stud by the locking pin 107 received within a corresponding opening 109 in the threaded male stud 79, after the wedge element 105 is fully threaded on the threaded male stud 79. A tapered or wedge surface 111 on the wedge element 105 engages the inner end 103 of the locking cylinder 97, while the wedge or tapering surface 95 of the wedge element 81 engages the inner end 101 of the locking cylinder 97. The circumferential depressions 113 formed in the interfitting telescoping section 5 are similarly designed to engage the outer margin or periphery of the wedge or tapered surface 111 to prevent axial separation of the interfitting telescoping sections 5 and 7 when assembled to one another. Thus, the circumferential depressions 113 enable the wedge element 105 to be restrained against axial separation, while also allowing the interfitting telescoping section 7 to be rotated relative to the interfitting telescoping section 5, enabling the second interlocking or internal expansion means 77 to cause the locking cylinder 97 to engage the inner wall of the interfitting telescoping section 5, in the same manner as described in connection with the interlocking or internal expansion means 41.

In a very similar, but slightly different manner, the interlocking or internal expansion means 115 for the interfitting telescoping sections 7 and 9 is provided with similar components, one of which is preferably slightly modified, as will be described. Specifically, the interlocking or internal expansion means 115 for the interfitting telescoping sections 7 and 9 includes a threaded male stud 117 that is received within a cylindrical element 119. Set screw 123 is received within the transverse opening 121 of the cylindrical element 119 for securely locking the threaded male stud 117 within the cylindrical element 119. A corresponding opening 125 in the interfitting telescoping section 9 allows the set screw 123 to be threadably driven into locking engagement relative to the threaded male stud 117. A second transverse opening 127 in the cylindrical element 119 receives the roll pin 129, the later, in turn, extending through an opening 131 in the interfitting telescoping section 9 to securely lock and retain the cylindrical element 119 within. As distinct from the other embodiments, the cylindrical element 119 does not have a wedge or tapering surface, since this has been found to be unnecessary for the smallest interfitting telescoping section 9; however, such may be provided, if desired. Adjacent the cylindrical element 119 is longitudinally slit locking cylinder 133 having an inner end 135 that is designed to be engaged and expanded by the cylindrical element 119. The other end of the locking cylinder 135 has inner end 137 designed to be engaged by the internally threaded wedge element 139 threadably received on the male threaded stud 117. Following threading of the wedge element 113 on the threaded male stud 117, the roll pin 141 may be inserted within the corresponding opening 143 of the threaded male stud 117, to prevent unauthorized retrograde movement of the wedge element 139 therefrom. Wedge or tapering surface 145 on the wedge element 139 engages the inner end 137 of the locking cylinder 133 in cooperative engagement with locking cylinder 119, which internally expands the locking cylinder 133 along the inner end 135 thereof, to radially expand the locking cylinder against the internal wall of the interfitting telescoping section 7, upon rotary movement of the telescoping interfitting section 9 relative to the telescoping interfitting section 7, causing the interlocking or internal expansion means 115 to operate as in the previous constructions. Again, circumferential depressions 147 or other similar circumferential surfaces formed in the interfitting telescoping section 7 are usefully employed to prevent axial movement of the wedge element 139, while the interfitting telescoping section 9 and the components of the interlocking or internal expansion means 115 associated therewith causes the locking cylinder 133 to be radially expanded into locking engagement with the inner wall of the interfitting telescoping section 7.

From the foregoing, it will be appreciated that the collapsible cane of the present invention has a series of interfitting telescoping sections 3, 5, 7 and 9 which are interlocked together once collapsed, such as by having the inner end 4 of the interfitting telescoping section 3 resiliently and externally gripped by the cane tip 13, and further is interlocked against collapse when the interfitting telescoping sections 3, 5, 7 and 9 are extended as shown in FIG. 2. As has been discussed above the interlocking or internal expansion means 41 for the interfitting telescoping sections 3 and 5, the interlocking or internal expansion means 77 for the interfitting telescoping sections 5 and 7, and the interlocking or internal expansion means 115 for the interfitting telescoping sections 7 and 9 interlock the aforementioned interfitting telescoping sections against collapse when extended. It has been discovered that the interlocking or internal expansion means 41, 79, 115 in association with the interfitting telescoping sections 3, 5, 7 and 9 provide substantial support and strength to the body weight of a handicapped user, without collapse of the interfitting telescoping sections. Simple rotary movement of adjacent interfitting telescoping sections relative to one another, when the interfitting telescoping sections are extended, causes the locking cylinders of the interlocking or internal expansion means 41, 77 and 115 to internally expand against the inner wall of adjacent interfitting telescoping sections, to provide locking engagement therewith along the full length of the locking cylinders. Rotating the interfitting telescoping sections in an opposite direction causes disengagement of the interlocking or internal expansion means, allowing collapse of the interfitting telescoping sections 3, 5, 7 and 9 relative to one another, to afford subsequent re-engagement of the inner end 4 of the outermost interfitting telescoping section 3 relative to the resiliently expandable collar 35 of the cane tip 13, as described above.

In view of the above, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

I claim:

1. A collapsible cane having a series of longitudinal interfitting telescoping sections from smallest to largest which are interlocked together when collapsed and interlocked against collapse when extended including, first interlocking means for externally interlocking said interfitting telescoping sections together as a unit when collapsed, said first interlocking means comprising a cane tip mounted at an outer free end of the smallest telescoping section and including external gripping means in the form of a resiliently expandable collar portion for engaging the largest telescoping section while all remaining telescoping sections are telescopically collapsed within the largest telescoping section so as to retain the interfitting telescoping sections together as a unit when telescopically collapsed, said first interlocking means including said cane tip external gripping means and its resiliently expandable collar portion being selectively disengaged from said largest interfitting telescoping section to permit longitudinal extension of said interfitting telescoping sections and second interlocking means for internally interlocking adjacent telescoping sections together against collapse when activated, and when de-activated enabling collapse and telescopic interfitting assembly of adjacent interfitting telescopic sections relative to one another from subsequent re-engagement with the first interlocking means.

2. The collapsible cane as defined in claim 1 wherein said resiliently expandable collar portion includes circumferentially extending and resiliently expandable fingers for resilient gripping engagement with one end of said largest interfitting telescoping section.

3. The collapsible cane as defined in claim 1 wherein said first and second interlocking means are independently operable relative to one another.

4. The collapsible cane as defined in claim 3 wherein said interfitting tubular sections are made out of aluminum, the largest outermost interfitting telescoping section is provided with an electric insulating hand gripping section, and said cane tip is made from plastic material also providing electrical insulating characteristics.

5. The collapsible cane as defined in claim 1 wherein said second interlocking means includes internal expansion means for engaging inner walls of said interfitting telescoping sections, when activated.

6. The collapsible cane as defined in claim 5 wherein internal expansion means are provided at one end of said interfitting telescoping sections for internal expansion and engagement with an inner wall of adjacent interfitting telescoping section, when activated.

7. The collapsible cane as defined in claim 6 wherein said internal expansion means is activated by rotating each interfitting telescoping section having an internal expansion means relative to an adjacent interfitting telescoping section.

8. The collapsible cane as defined in claim 7 wherein each internal expansion means includes wedge elements for engaging and expanding a locking cylinder against an internal wall of an adjacent interfitting telescoping section.

9. The collapsible cane as defined in claim 8 wherein said wedge elements are mounted on opposite sides of said locking cylinder for axial engagement therewith to provide radial expansion of said locking cylinder when engaged thereby.

10. The collapsible cane as defined in claim 9 wherein said wedge elements are threadably mounted on a threaded stud extending from one end of said interfitting telescoping sections.

11. The collapsible cane as defined in claim 10 wherein each adjacent interfitting telescoping section to be engaged along an internal wall thereof by the locking cylinder expanded by said wedge elements includes means restricting axial separation of said interfitting telescoping sections.

12. The collapsible cane as defined in claim 11 wherein said last mentioned means engages one of said wedge elements to enable said wedge elements to move axially toward one another for radial expansion of said locking cylinder.

13. A collapsible cane having a series of interfitting telescoping sections which are interlocked against collapse when extended, said interfitting telescoping sections carrying internal expansion means for engagement with an inner wall of adjacent interfitting telescoping sections, when activated, to interlock adjacent telescoping sections together against collapse, and when deactivated, permitting collapse and telescopic interfitting assembly of adjacent interfitting telescopic sections relative to one another, said internal expansion means being provided at one end of said interfitting telescoping sections for internal expansion and engagement with an inner wall of adjacent interfitting telescoping sections, each internal expansion means including a pair wedge elements threadably mounted on a threaded stud that extends from one end of said interfitting telescoping sections, each pair of wedge elements being positioned on said threaded stud on opposite sides of a longitudinally slit locking cylinder for axial engagement therewith to provide radial expansion of said locking cylinder when engaged thereby so as to interlock adjacent telescoping sections together against collapse.

14. The collapsible cane as defined in claim 13 and including external interlocking means for externally interlocking said interfitting telescoping sections together as a unit when collapsed.

15. The collapsible cane as defined in claim 14 wherein said external interlocking means includes external gripping means mounted on the smallest telescoping section for circumferential gripping of the largest telescoping section while the remaining interfitting telescoping sections are telescopically collapsed therein.

16. The collapsible cane as defined in claim 15 wherein said external gripping means comprises a cane tip including a resiliently expandable collar for releasable engagement and disengagement relative to an outer free end of said smallest telescoping section.

17. The collapsible cane as defined in claim 13 and including circumferential depression means formed in the interfitting telescopic sections, which have inner walls engaged by said locking cylinders, for engaging one of said wedge elements to restrict axial separation of said interfitting telescoping sections, while enabling said wedge elements to be axially threadably moved into engagement with said locking cylinder for radial expansion thereof.

18. A collapsible cane having a series of interfitting telescoping sections from smallest to largest which are held together as a unit when collapsed and interlocked against collapse when extended, said interfitting telescoping sections carrying internal expansion means for engagement with an inner wall of an adjacent telescoping section to interlock adjacent telescoping sections together against collapse, when extended, and external releasable gripping means mounted at one end of the smallest telescoping section including a cane tip having a resiliently expandable collar portion for a releasably engaging one end the largest telescoping section while all remaining sections are held within the outermost telescoping section in order to hold said sections together as a unit, when collapsed.

19. A collapsible cane having a series of interfitting telescoping sections which are interlocked against collapse when extended including rotary interlocking means for locking engagement with internal walls of adjacent telescoping sections when extended, and axial interlocking means for releasable axial locking engagement with an outermost telescoping section when said interfitting telescoping sections are telescoped together while retaining said remaining telescoping sections as a unit within said outermost telescoping sections, said axial interlocking means being provided at an outer free end of the smallest telescoping section and including a cane tip having a resiliently expandable collar portion for releasably engaging and disengaging one end of the largest telescoping section.

20. The collapsible cane as defined in claim 19 wherein said rotary interlocking means includes internal expansion means provided at one end of said interfitting telescoping sections for engaging a circumferential supporting surface on an adjacent interfitting telescoping section to permit said internal expansion means to expand in locking engagement relative to the inner wall of an interfitting telescoping sections to interlock adjacent interfitting telescoping sections together.

21. The collapsible cane as defined in claim 20 wherein said internal expansion means includes wedge elements threadably mounted on threaded studs extending from one end of said interfitting telescoping sections, and longitudinally slit expansion cylinders also mounted on said threaded studs between said wedge elements for axial engagement thereby to cause radial expansion and locking engagement of said expansion cylinders against inner walls of said adjacent interfitting telescoping sections.

* * * * *